US005988834A

United States Patent [19]

Latzel

[11] Patent Number: 5,988,834

[45] Date of Patent: Nov. 23, 1999

[54] LAMP AND METHOD FOR FORMING A LAMP BODY

[76] Inventor: Michael Latzel, Schleissheimer Strasse 411, 80935 München, Germany

[21] Appl. No.: 08/881,963

[22] Filed: Jun. 25, 1997

[30] Foreign Application Priority Data

Jun. 25, 1996 [DE] Germany ..... 196 25 381

[51] Int. Cl.[6] ..... F21V 17/02

[52] U.S. Cl. ..... 362/320; 362/278; 362/352

[58] Field of Search ..... 362/319, 320, 362/278, 352

[56] References Cited

U.S. PATENT DOCUMENTS 1,547,026 7/1925 Canney ..... 362/320

1,959,931 5/1934 Schwartz ..... 362/278

*Primary Examiner*—Alan Cariaso

*Assistant Examiner*—Todd Reed Hopper

*Attorney, Agent, or Firm*—Horst M. Kasper

[57] ABSTRACT

The present invention provides a lamp comprising a lamp body formed by one single device component. The device component is formed of a foil made of a bendable, elastic material. The foil exhibits a bending line near a center of the foil. The foil contains an opening for receiving the illuminating device and/or current-carrying parts. The foil is formed to a curved, central wave fold by exerting a light pressure from two sides toward the center of the foil based on the bendable and elastic properties of the foil. The curved, central wave fold ends at said bending line. The foil assumes a cap-like spatial structure based on a partial deformation along the bending line caused by the light pressure. The cap-like or hood-like foil can be then easily fixed in this spatial structure by means of a suitable tightening, clamping, or locking device. The entire lamp body is stable and fixed in this spatial structure.

22 Claims, 6 Drawing Sheets

LAMP AND METHOD FOR FORMING A LAMP BODY

BACKGROUND OF THE INVENTION

1. Field of the Invention

The invention relates to a lamp and a method for forming a lamp body out of a single device component.

2. Brief Description of the Background of the Invention Including Prior Art

The free-market economy calls for a continuing effort for rationalization in all fields. There is a steady need for an economic manufacture of the respective products and an efficient procedure and logistics of the marketing and of the sales effort. This was the reason, for example, for interior decorating houses to introduce furniture series which are produced as component kits, where the transport requires little space, and there these component kits can then be set up and mounted by a professional or by the end user.

Such a practice can be even less observed in the field of lighting technology. The reasons for this could mainly lie with the individual and complex, three-dimensional structures of lamps, but also the type of the conventionally employed materials, preferably metal and glass, which up to now excluded the building component principle at least for qualitatively high-value lamps.

Simple lamp shades, made of rice paper or a similar material, are known, where the lamp shades are transported and stored in a folded state, and where the lamp shades are then suspended for example in the form of a balloon or an open cylinder.

SUMMARY OF THE INVENTION

PURPOSES OF THE INVENTION

It is an object of the present invention to provide for lamps having a complex three-dimensional structure, where the lamps are made of a qualitatively high-value material but can nevertheless be economically manufactured and can be stored and transported in an advantageous way.

It is a further object of the present invention to provide for lamps which are made of a reduced number of building components and which are capable of standing in an upright position without needing separate equipment such as a pedestal or stand supports.

These and other objects and advantages of the present invention will become evident from the description which follows.

BRIEF DESCRIPTION OF THE INVENTION

The present invention provides a lamp comprising a lamp body formed by one single device component. An illuminating device is attached to the lamp body. The device component is formed of a foil made of a bendable, elastic material. The foil exhibits a bending line near a center of the foil. The foil contains an opening for receiving the illuminating device and/or current-carrying parts. The bending line surrounds the opening. The foil is formed to a curved, central wave fold by exerting a light pressure from two sides toward the center of the foil based on the bendable and elastic properties of the foil. The curved, central wave fold ends at said bending line. The foil assumes a cap-like spatial structure based on a partial deformation along the bending line caused by the light pressure. There is provided a clamping device for retaining the shape of the foil. A bending tension of the foil is maintained by the clamping device. The current-carrying parts and the illuminating device are preferably premounted and preassemble and can be easily mounted or fixed as one device to the lamp body. This construction results in a safety-proof structure. Current-carrying parts are mounted to the lamp body and connected to the illuminating device. The entire lamp body is stable and fixed in this spatial structure.

The present invention is based in part on the surprising recognition that a qualitatively high-value lamp body can be formed out of a bendable, elastic foil in a simple way. Such a foil exhibits an open or closed folding and bending line approximately in the center of the foil. By exerting a light pressure from two sides of the foil toward the center of the foil, a curved, center wave fold is formed, which fold ends at the recited folding and bending line. The foil assumes a cap-like or a hood-like spatial structure based on the partial deformation along the folding and bending line caused by the pressure. The cap-like or hood-like foil can be then easily fixed in this spatial structure by means of a suitable tightening, clamping, or locking device.

The formed, stable spatial structure does not only exhibit an aesthetically appealing, attractive form of the structure, but represents also with respect to functionality a sound integration of lamp shade or, respectively, reflector, receptacle for illuminating device, and lamp base.

The lamps according to the present invention exhibit a series of essential advantages as compared to comparable, conventional lamps:

a) The lamp bodies can be produced easily and economically based on the simple form of the foils to be employed.

b) The lamps can be transported and stored in a secure way in the form of a component kit, which includes all necessary components, in particular the lamp-body foil in its unclamped form, while saving storage space and packing material at the same time.

c) The lamps can be mounted and dismounted with only a few simple manual steps.

The lamps according to the present invention achieve thereby the desired features.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
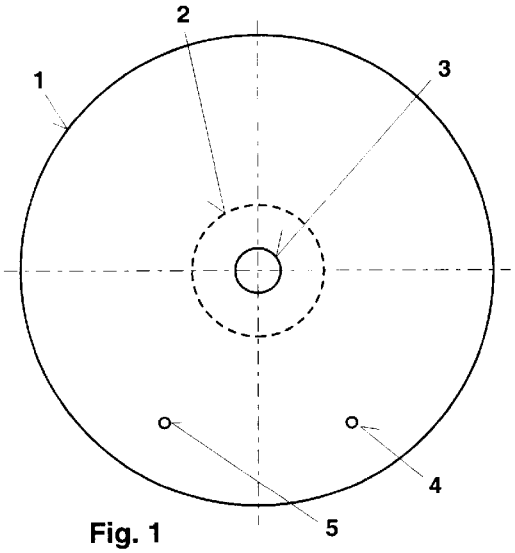
FIG. 1 shows a top view of a blank of a foil as a circular disk.

The present invention provides for a lamp comprising a lamp body, an illuminating device 8, as well as a clamping device 7 and current-carrying parts. The lamp body is formed by one single device component. The device component is formed of a foil 1 made of a bendable, elastic material. The foil 1 exhibits an open or a closed bending line 2 near a center of the foil 1, where the bending line 2 surrounds an opening 3 for receiving the illuminating device 8 and/or the current-carrying parts. This foil 1 can be pushed to a curved, central wave fold by exerting a light pressure from two sides toward the center of the foil 1 based on the bendable and elastic properties of the foil 1. The wave fold ends at said bending line 2. The foil 1 assumes a cap-like spatial structure based on a partial deformation along the bending line 2 caused by the pressure. The bending tension is maintained by a suitable clamping device 7. The entire lamp body is stable and fixed in this spatial structure. The bending line 2 can be round.

The lamp body, formed by the fixed spatial form, can stand stable and upright.

The foil 1 is a circular to elliptical disk.

A segment can be cut from the lower edge of the circular to elliptical disk of the foil 1 along a section line 6.

The contour of the bending line 2 can be the complete or incomplete circumferential line of a circle, including a circular angle of more than 180 degrees.

The bending line 2 can be disposed centered in the middle of the foil 1 or can be disposed eccentrically on the center axis of the foil 1 shifted downwardly.

The distance of the bending line 2 from the nearest edge of the foil 1 can amount to at least one sixth of the smallest foil diameter.

The diameter of the bending line 2 can amount to between 20 and 30% of the largest foil diameter.

The opening 3 can be disposed centered in the middle of the bending line 2.

The opening 3 can be larger than an imaginary opening would be necessary for receiving the illuminating device 8 such that a partially open lamp body is formed.

The clamping device 7 can be disposed in the lower third of the lamp body. The clamping device 7 can be guided through two receiver openings 4, 5 at the flanks of the wave fold.

The bending line 2 can be formed by a method selected from the group consisting of perforation, scoring, film-hinge pressing, generation of a crease or a groove.

The bending line 2 can be formed by a slot. The oppositely disposed edges of the slot can be connected by connection means such as one or more rings, wire, cable, string or the like for maintaining the clamping in the region of the bending line 2.

The foil 1 can be made of metal, plastic, reinforced plastics, or treated paper having a high restoring force.

The foil 1 can be made of a steel having an elastic restoring force comparable to hard-rolled V2A steel.

The clamping device 7 can be a member of the group selected from a clamp clip, clamping ring, turnbuckle, pulling bolt, a cable, pipe, tube, a string, chain, clasp, or a tension spring.

The fixing of the spatial form of the lamp body can be performed by a suitable guiding of the current-carrying parts proper.

The lamp body can be comprised of at least two superposed layers of said foil materials.

The present invention further provides for a device component kit for assembling a lamp. The device component kit includes a foil 1 with a bending line 2 and an opening 3. The foil 1 is deformable along the bending line 2 to form a cap-like spatial structure. A first receiver opening 4 and a second receiver opening 5 are disposed close to an outer edge of the foil. An illuminating device 8 is included in the kit to be placed into the opening 3. A clamping device 7 is provided to be placed into the first receiver opening 4 and the second receiver opening 5, thereby maintaining the cap-like spatial structure of the foil 1. A connection cable 12 or another suitable means is provided for supplying current. The clamping device 7 can include a device for regulating the light intensity and/or the current supply, the transformers, the ignition loading series device, and the like.

Moreover, the present invention provides for a method for forming a lamp body, wherein a bendable, elastic foil 1 exhibits approximately in the center an open or closed bending line 2. The bending line 2 surrounds an opening 3 for receiving the illuminating device 8 and/or the current-carrying parts. The bendable, elastic foil 1 is pushed to a curved central wave fold by exerting a light pressure from two sides toward the middle. The wave fold runs out at the bending line 2. The foil 1 assumes a cap-like spatial structure based on a partial deformation along the bending line 2 caused by the pressure. The bending tension can be maintained by a suitable clamping device 7. The entire lamp body is stable and fixed in this spatial structure.

A lamp in the context of the present invention can be a floor lamp or a table lamp for interior spaces, such as living quarters and offices.

The contour of the foil 1 represents an important parameter for the structure of the spatial structure to be formed.

Figure 2:
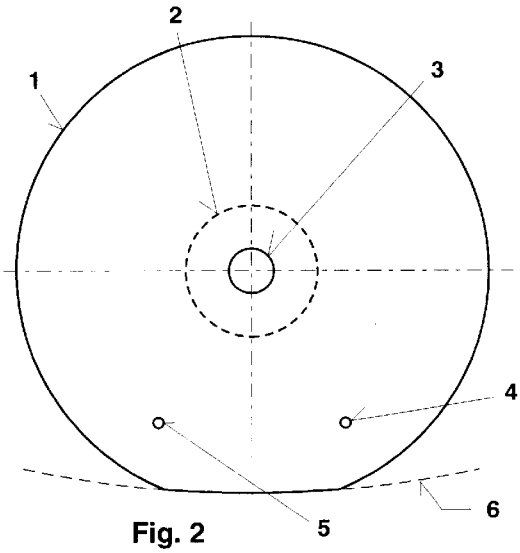
FIG. 2 shows the circular disk of FIG. 1, where a segment was cut from the lower edge of the disk.

Basically, all contour forms are suitable which can be pushed together to the wave fold of claim 1. This can include both contour forms having straight sides, for example, rectangles, squares, as well as contour forms having round contours. Oval, elliptical, and round contours are preferred, and in particular the form of a circle is preferred. Even though round contours also result in a spatial structure being stable in an upright position, a segment can be cut off along a section line 6 from the lower edge of the disk forming the foil 1 for achieving an increased stability in an upright position, wherein the section line 6 can be straight or slightly curved, as shown in FIG. 2, or where the lower edge of the formed spatial structure is weighed down with weights or is stabilized in another way.

The foil in the context of the present invention is furnished as a circular disk, such as floppy disks, made of a thin material and having a thickness of from 0.2 mm to 2 mm.

Any material having the required bending and elastic properties is suitable to be employed for the material of the foil 1. Materials such as metals, plastics, reinforced and layered plastics, and treated paper having a high restoring force are suitable. A particularly preferred metal is hard-rolled V2A steel or a steel with a comparable restoring force. Particularly preferred plastics are polycarbonate or polycarbonate derivatives, for example, interpolymers with polycarbonate. In particular glassfiber reinforced plastics (GFK) are to be named as reinforced plastics.

The foil thickness can vary in a wide range depending on the kind of material employed, on the lamp size, and on the purpose of the lamp (for example, table lamp, floor lamp, wall lamp). However, the wall thickness is generally in the range of from between 0.05 mm to 5 mm, and preferably from between 0.1 to 2 mm.

Foils of the desired material and of the desired thickness can be obtained in commerce or can be easily produced according to conventional methods.

The bending line 2 can be each open or closed line which results in a deformation of the clamped and tensioned foil 1 to the desired cap-like spatial structure. Therefore, an open bending line 2 has nevertheless to be closed up to such a point that the recited deformation can occur. An closed bending line forms a complete circle of 360 degrees or respectively, an open bending line forms a circle of 210 degrees. The angle covered between the two sides of material across the bending line can be from 110 degrees to 170 degrees and is preferably from about 120 degrees to 150 degrees. This can be recognized in particular in FIGS. 3 and 9. However, the person skilled in the art can easily and clearly determine this in each individual case based on simple bending tests. Round bending lines 2 are clearly preferred. A non-round bending line 2 in general does not result in a smooth folding contour. A polygon with a large number of corners would also be suitable or its incomplete circumferential line, such that an at least approximately round bending line 2 would be present. Preferred closed bending lines 2 are the circumferential lines of circles, ovals, and ellipses, and particularly preferred is a circular circumference. Preferred open bending lines 2 are the incomplete circumferential lines of circles and ellipses, which include a circle angle or an ellipse angle of more than 120 degrees, and preferably of more than 180 degrees, for example a three-quarter circular circumference. Preferably, the eccentricity of such an ellipse as the ratio of the size of the longer ellipse axis to the smaller ellipse axis is less than 2. The angle in the bending line at the outside amounts to from 180 to 110 degrees. The bending line is a defined set bending line/set folding line, produced by a perforation etc. and is analog to a set breaking position.

The bending line 2 is preferably centered in the middle of the foil 1. However, the bending line 2 can also be disposed eccentrically as long as there results the desired spatial structure. The eccentric disposition of the bending line 2 is preferably brought about by shifting the centered bending line 2 on the center axis in a downward direction.

The distance of the bending line 2 to the nearest edge of the foil 1 amounts preferably to at least one sixth of the smallest foil diameter.

The diameter of the bending line 2 amounts preferably to between 15 to 40%, and particularly preferred to between 20 to 30%, of the largest foil diameter.

The bending line 2 is preferably generated by a cross-section variation based in its size on the material employed, for example crease, groove, film-hinge embossment, scoring, or by a perforation such as circular aperture perforation or slotted hole perforation.

The formation as a slot is also possible. In this case, however, stabilizing means are required for maintaining the tensioning and clamping in the region of the bending line 2 in the clamped spatial structure. The stabilization can for example be brought about for example by connecting the oppositely disposed edges of the slot with a clamping device 6, such as rings, wire, cable, strings, or the like. A further possibility are additionally disposed clamps or clips.

The opening 3 can be disposed centeredly or eccentrically within the bending line 2. The exact position of the opening 3 does not influence the spatial structure of the lamp body, but rather only dictates the position of the illuminating structure or device 8. However, a centered disposition is also preferred for optical reasons. The opening 3 can also be larger than is required for the receiving of the illuminating device 8. In this case there results a lamp body with a partially open rear wall.

A lamp body in the context of the present invention includes a structure integrating a lamp shade, possibly a reflector, and a lamp pedestal.

Suitable illuminating devices 8 include, for example, conventional light bulbs, halogen lamps, energy-saving lamps, or low-voltage luminous elements in addition to the holder, the fixture, and the support structure as well as, possible, a diffuser agent.

A plurality of clamping means 7 are suitable for maintaining the clamping of the formed spatial structure. Concrete examples therefor are a clamp clip, clamping ring, turnbuckle, pulling bolt, a cable, pipe, tube, a clasp, chain, a string, or a tension spring. The clamping means 7 balances and limits the spring force of the bulging of the material such as does string and bow or as en encircling clip, which receives the restoring force of the material.

Current-carrying parts itself, for example, connection cables 12, can be employed as clamping device 7.

According to a particularly preferred embodiment, the clamping device 7 is disposed in the lower third of the lamp body, where the clamping device 7 is guided through two receiver openings 4, 5 at the flanks of the wave fold.

Figure 9:
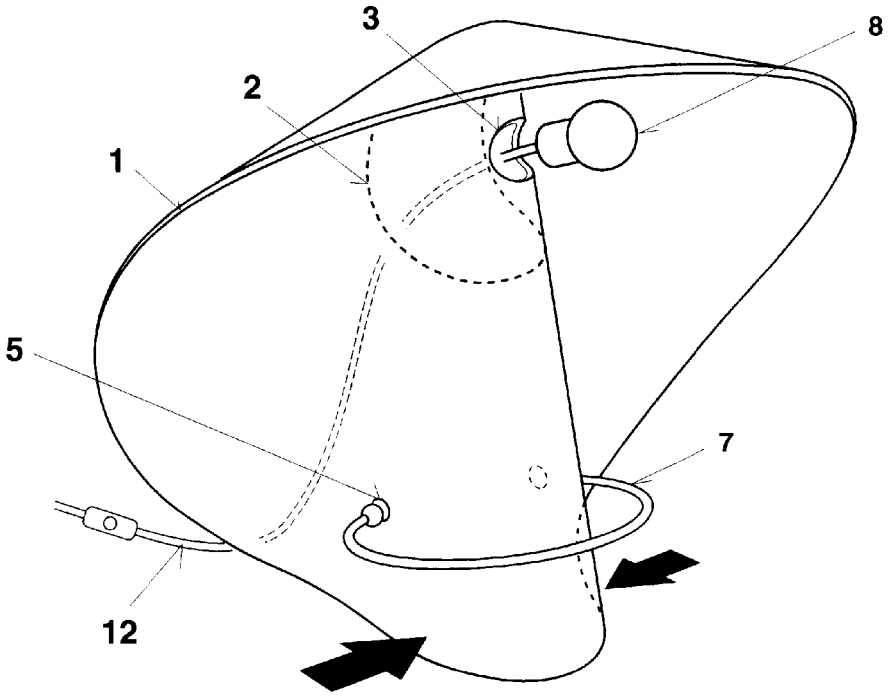
FIG. 9 shows a perspective view of a third embodiment of a lamp body, where the lamp body is created by folding and deforming the circular disk of FIG. 1.

If the clamping device 7 is furnished by a clamp clip, then the clamp clip can either support the wave fold from the back side (inner placement, cf. FIG. 14) or can surround the wave fold from the front (external placement, cf. FIG. 9).

According to a preferred embodiment, the lamp bodies are formed out of at least two superposed layers of the recited foil material, where the material employed in the two layers can be identical or different. For example, the outer surface layer could be furnished by a highly reflecting metal foil 1 and the rearward layer could be furnished by a matted metal foil 1 or a plastic foil 1. The foil material can be hardened by rolling and by providing a densification of structure as is the case with hard-rolled steel.

An invisible guiding of current-carrying cables 12 and/or a suitable clamping device 7 is made possible by the use of two superposed foil layers. Power can be furnished to the illuminating device by a cable connected to a power supply or to an electric power grid. The amount of power supplied to the illuminating device can be controlled by a dimmer or power control device inserted into the power feeding cable.

A few of the particularly preferred embodiments are shown in FIGS. 1–18.

A blank of a foil 1 is shown as a circular disk with a centered circular bending line 2 in FIG. 1, where the centered circular bending line 2 surrounds again a centered opening 3. Furthermore, the circular disk exhibits in the lower third two receiver openings 4 and 5.

The circular disk of FIG. 1 is shown also in FIG. 2 but with the difference that a segment was cut from the lower edge of the disk, wherein the section line 6 follows a slight arc.

Figure 3:
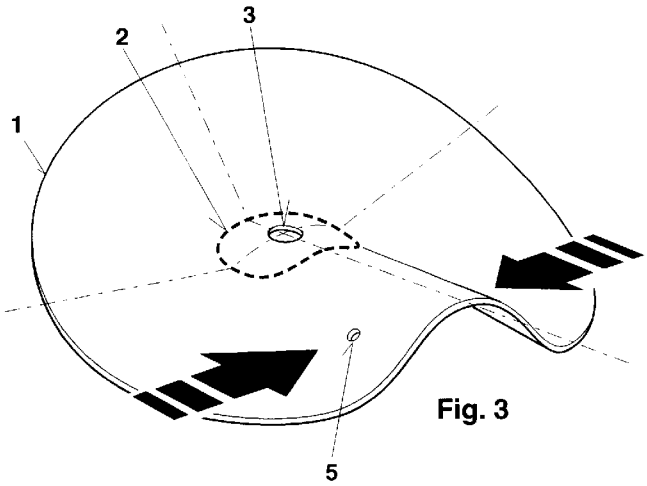
FIG. 3 shows a top view onto the circular disk of FIG. 1, where the deformation of the circular disk has been partly formed.
Figure 6:
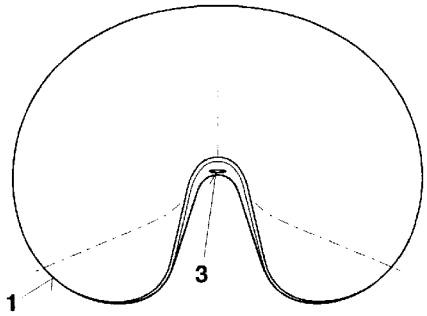
FIG. 6 is a bottom planar view of the embodiment of FIG. 4.
Figure 5:
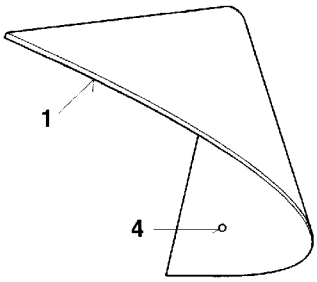
FIG. 5 is a right side view of part of the second embodiment.
Figure 4:
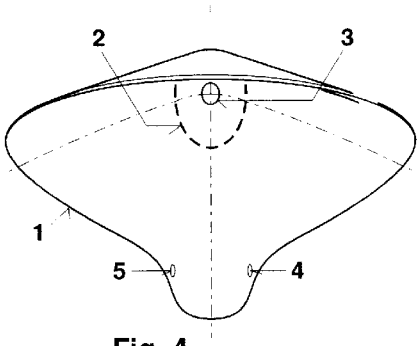
FIG. 4 is a front elevational view of a second embodiment employing a circular disk.
Figure 7:
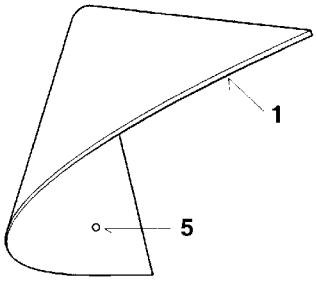
FIG. 7 is a left side view of part of the second embodiment.
Figure 8:
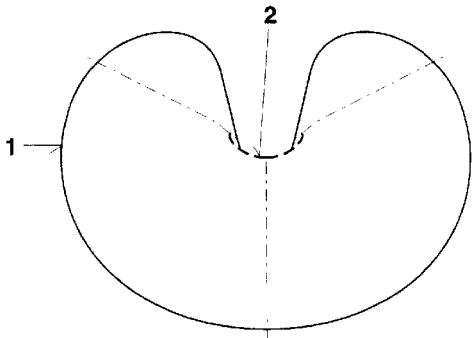
FIG. 8 is a top planar view of the embodiment of FIG. 4.

FIG. 3 shows the circular disk of FIG. 1, where the deformation of the circular disk has been partly formed.

FIGS. 4 through 8 show a front view, a left and right side view, as well as a top planar and a bottom planar view of the deformed foil 1.

Figure 10:
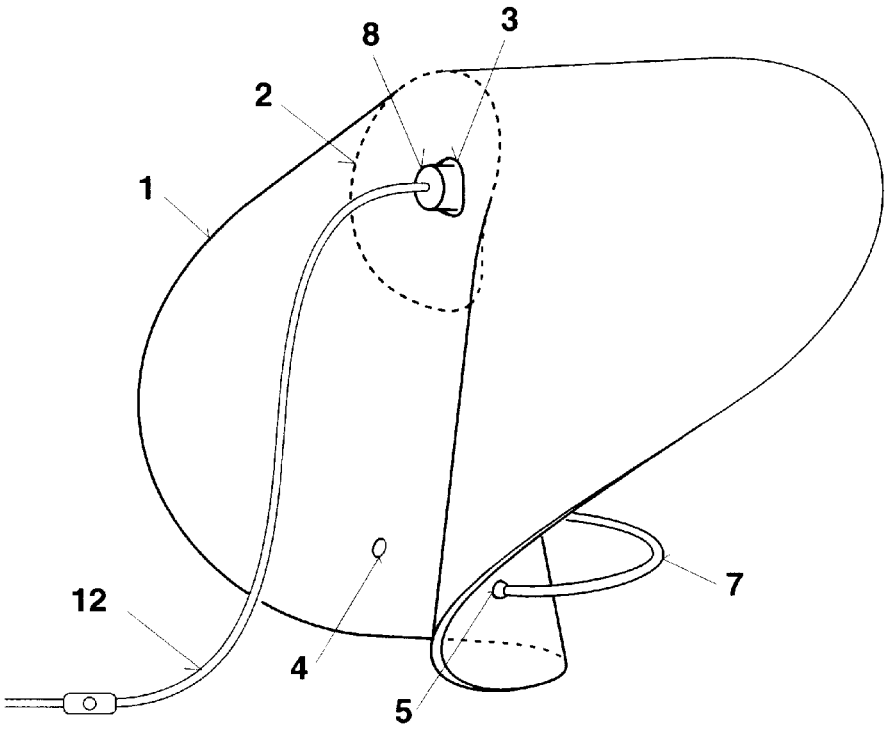
FIG. 10 shows a perspective rear view of the third embodiment.

The lamp body shown on FIGS. 9 and 10, created by folding and deforming the circular disk of FIG. 1, is capable of being placed and stable in an upright position. A clamp clip 7 grips at the flanks of the wave fold at the receiver opening 4 and 5 and fixes the formed spatial structure.

Figure 11:
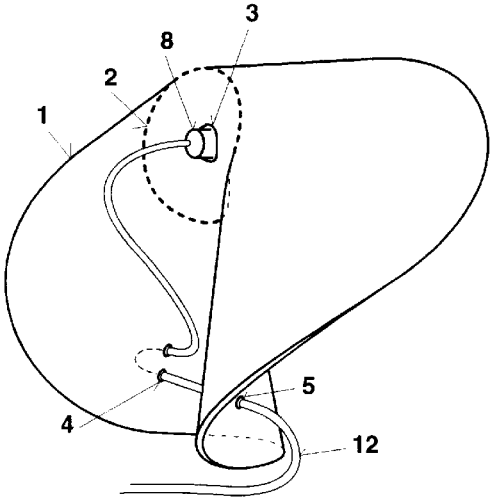
FIG. 11 shows a perspective rear view of a fourth embodiment with a lamp.

The clamped spatial structure of the lamp body of FIG. 11 is fixed only by the guiding of the connection cable 12 proper.

Figure 12:
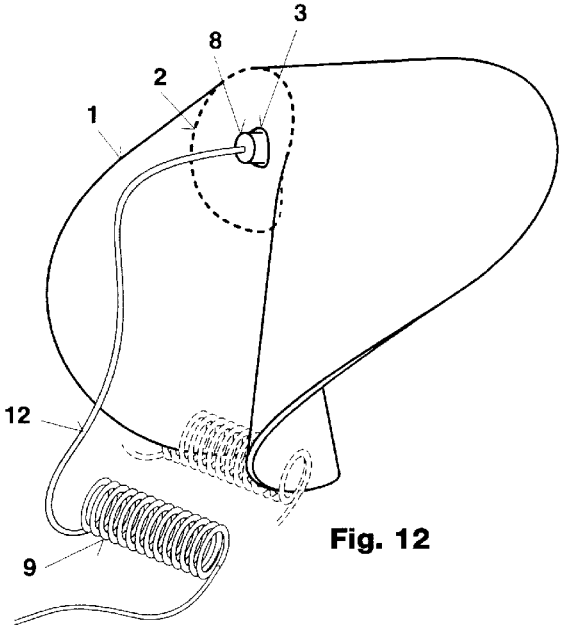
FIG. 12 shows a perspective rear view of a fifth embodiment with a lamp.

The lamp according to FIG. 12 is fixed in its spatial structure based on a spirally coiled, stiffened section 9 of the connection cable 12.

Figure 13:
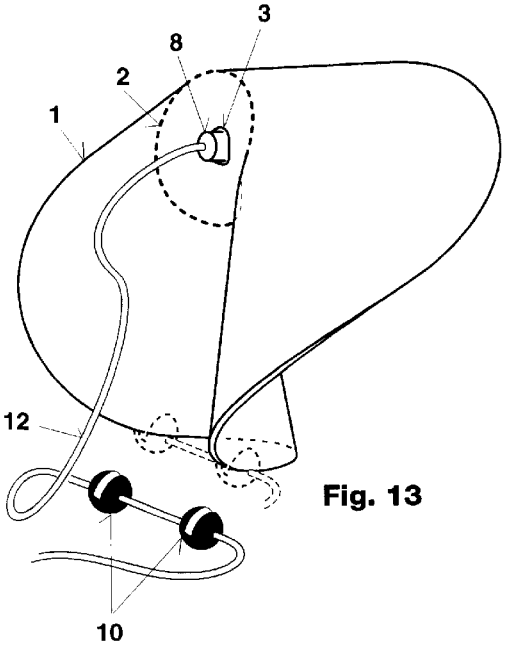
FIG. 13 shows a perspective rear view of a sixth embodiment with a lamp.

In the lamp body of FIG. 13, the spatial structure is fixed by guiding the connection cable 12 through two cable supports 10, having in each case a receiver slot. The lower edge of the lamp body can be inserted into the receiver slots of the cable supports 10 and can thereby be fixed.

Figure 14:
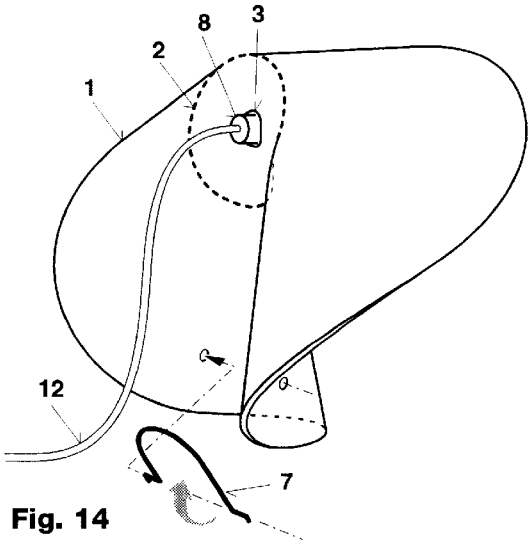
FIG. 14 shows a perspective rear view of a modified third embodiment with a lamp, where the fixing occurs based on a clamp clip from the rear side (internal positioning)
Figure 15:
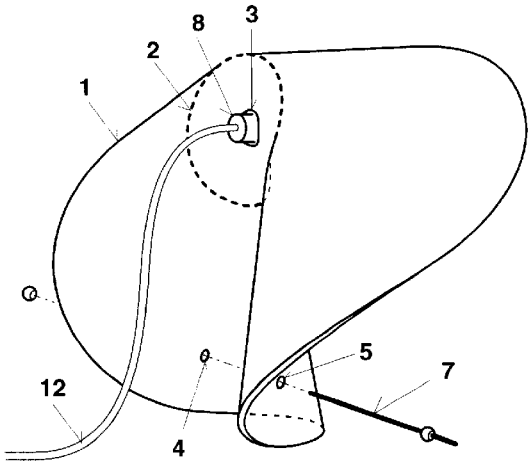
FIG. 15 shows a perspective rear view of a modified third embodiment with a lamp, where the fixing occurs based on a bolt or a pin.

FIG. 14 shows a lamp, where the fixing occurs based on a clamp clip from the rear side (internal positioning) and in the lamp of FIG. 15, the fixing occurs based on a bolt or a pin.

Figure 16:
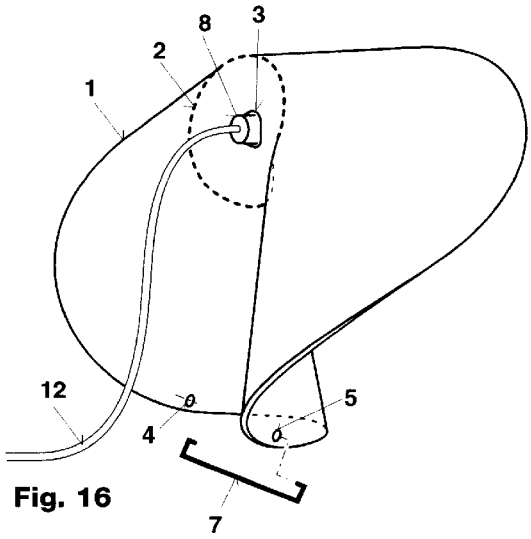
FIG. 16 shows a perspective rear view of a modified third embodiment with a lamp, where the fixing occurs with a clasp.
Figure 17:
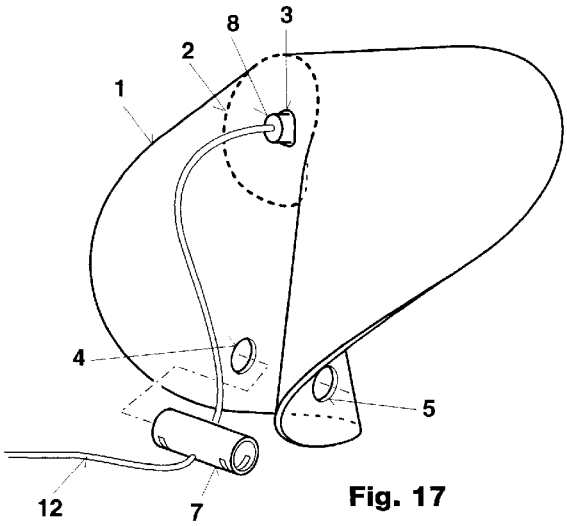
FIG. 17 shows a perspective rear view of a modified third embodiment with a lamp, where the fixing occurs with a tube-like object, where this object can for example be a transformer or an ignition coil.

In the lamp of FIG. 16, the fixing occurs with a clasp, and in the lamp of FIG. 17, the fixing occurs with a tube-like object, where this object can for example be a transformer or an ignition coil.

Figure 18:
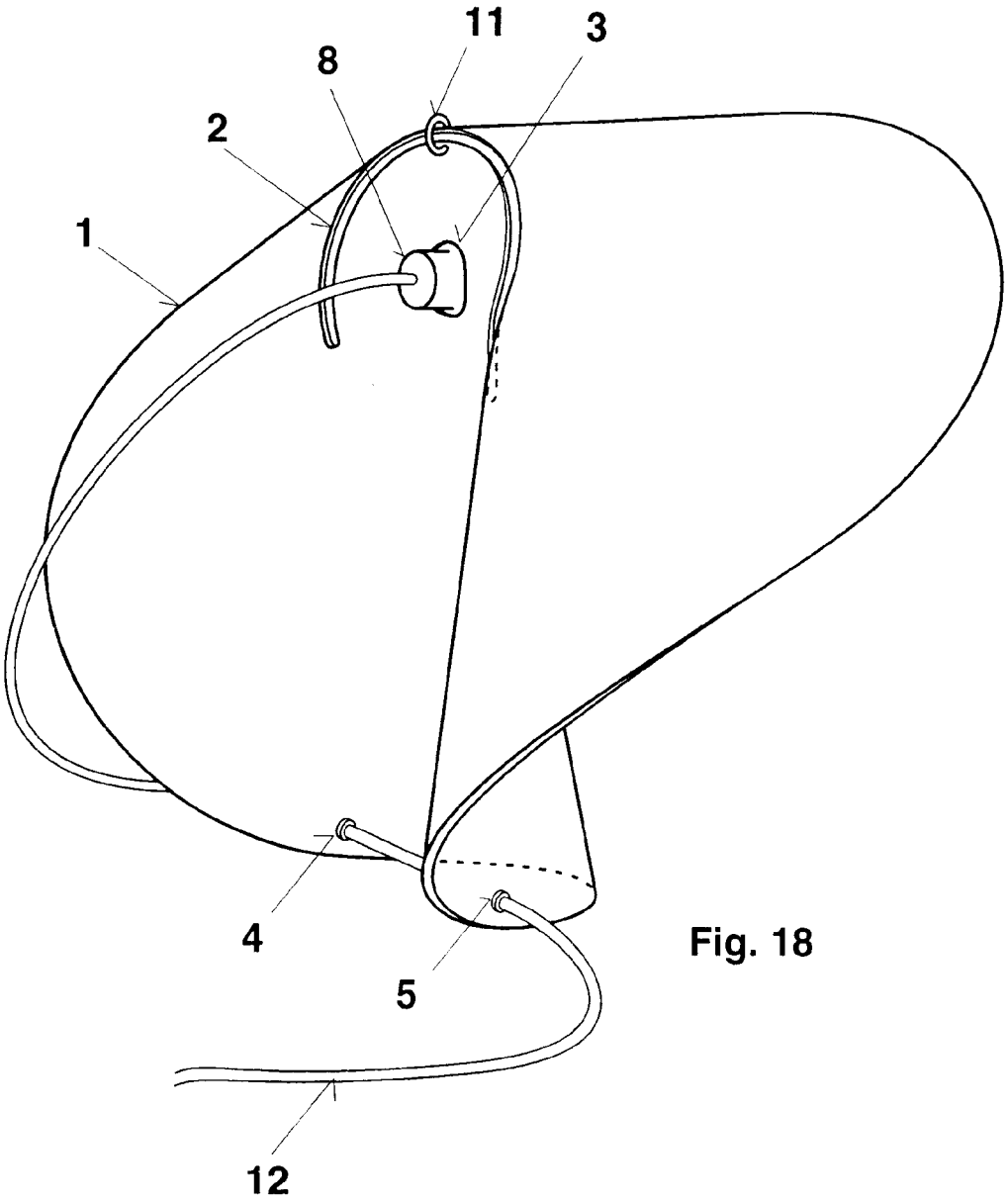
FIG. 18 shows a perspective rear view of a seventh embodiment of a lamp, where the bending line is formed by a slot, and where the oppositely disposed edges of the slot are connected with a ring.

A lamp is shown in FIG. 18, where the bending line 2 is formed by a slot, and where the oppositely disposed edges of the slot are connected with a ring 11.

As recited above, the lamps according to the invention can be advantageously transported and stored in the form of a device component kit accompanied by a saving in storage space and packing material. Such a device component kit can also contain:

a) a foil 1 with a bending line 2 and an opening 3 b) an illuminating device 8 c) a clamping device 7 d) a connection cable 12 or another device for the supply of current e) possibly a means for regulating the light intensity and/or the current supply, transformers, ignition loading series device and the like.

The illuminating device 8 comprises, for example, a light bulb in addition to the holder, fixture, or a socket and the support as well as possibly a diffuser. Preferably, the illuminating device 8 and the connection cable 12 are already connected to each other in order to facilitate the mounting of the illuminating device 8.

A further object of the present invention is also a method for forming a lamp body. A bendable, elastic foil 1 exhibits approximately in the center an open or closed bending line 2. The bending line 2 surrounds an opening 3 for receiving the illuminating device 8 and/or the current-carrying parts. The bendable, elastic foil 1 is pushed to a curved central wave fold by exerting a light pressure from two sides toward the middle. The light pressure has to be larger than the bending stiffness of the foil and can be less than twice the bending stiffness of the foil. The wave fold runs out at the bending line 2. The foil 1 assumes a cap-like spatial structure based on a partial deformation along the bending line 2 caused by the pressure. The wave-shaped bulging of the foil can assume a sector of about 90 degrees of a circular foil disk caused by a defined tipping of the oppositely disposed sector by 270 degrees along the set bending line. The bending tension can be maintained by a suitable clamping device 7. The entire lamp body is stable and fixed in this spatial structure.

It will be understood that each of the elements described above, or two or more together, may also find a useful application in other types illuminating means differing from the types described above.

While the invention has been illustrated and described as embodied in the context of a lamp and a method for forming a lamp body, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic Properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the bending line (2) is round.

2. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the bending line (2) is disposed centered in the middle of the foil (1) or is disposed eccentrically on the center axis of the foil (1) shifted downwardly.

3. The lamp according to claim 2, wherein the lamp body, formed by the fixed spatial form, stands stable and upright.

4. The lamp according to claim 2, wherein the foil (1) is a circular to elliptical disk.

5. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the foil (1) is a circular to elliptical disk, and wherein a segment is cut from the lower edge of the circular to elliptical disk of the foil (1) along a section line (6).

6. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the contour of the bending line (2) is the complete or incomplete circumferential line of a circle, including a circular angle of more than 180 degrees.

7. The lamp according to claim 2, wherein the distance of the bending line (2) from the nearest edge of the foil (1) amounts to at least one sixth of the smallest foil diameter.

8. The lamp according to claim 2, wherein the diameter of the bending line (2) amounts to between 20 and 30% of the largest foil diameter.

9. The lamp according to claim 2, wherein the opening (3) is disposed centered in the middle of the bending line (2).

10. The lamp according to claim 2, wherein the opening (3) is larger than would be necessary for receiving the illuminating device (8) such that a partially open lamp body is formed.

11. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the clamping device (7) is disposed in the lower third of the lamp body, and wherein the clamping device (7) is guided through two receiver openings (4, 5) at the flanks of the wave fold.

12. The lamp according to claim 2, wherein the bending line (2) is formed by a method selected from the group consisting of perforation, scoring, film-hinge pressing, generation of a groove.

13. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the bending line (2) is formed by a slot, wherein the oppositely disposed edges of the slot are connected by connection means such as one or more rings, wire, cable, string or the like for maintaining the clamping in the region of the bending line (2).

14. The lamp according to claim 2, wherein the foil (1) is made of metal, plastic, reinforced plastics, or paper-coated carrier foil made of plastic having a high restoring force.

15. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the foil (1) is made of a steel having an elastic restoring force comparable to hard-rolled V2A steel.

16. The lamp according to claim 2, wherein the clamping device (7) is a member of the group selected from a clamp clip, clamping ring, turnbuckle, pulling bolt, a cable, pipe, tube, a string, chain, clasp, or a tension spring.

17. A lamp comprising a lamp body, an illuminating device (8) and current-carrying parts (12) premounted to an installation kit, as well as a clamping device (7), wherein the lamp body is formed by one single device component, wherein the device component is formed of a foil (1) made of a bendable, elastic material, wherein the foil (1) exhibits a bending line (2) near a center of the foil (1), where the bending line (2) surrounds an opening (3) for receiving the illuminating device (8) and/or the current-carrying parts, wherein this foil (1) can be pushed to a curved, central wave fold by exerting a light pressure from two sides toward the center of the foil (1) based on the bendable and elastic properties of the foil (1), wherein the wave fold ends at said bending line (2), wherein the foil (1) assumes a cap-like spatial structure based on a partial deformation along the bending line (2) caused by the pressure, and wherein the bending tension is maintained by a suitable clamping device (7), and wherein the entire lamp body is stable and fixed in this spatial structure;

wherein the fixing of the spatial form of the lamp body is performed by a suitable guiding of the current-carrying parts proper.

18. The lamp according to claim 2, wherein the lamp body is comprised of at least two superposed layers of said foil materials.

19. Device component kit for assembling a lamp, comprising a foil (1) with a bending line (2) and an opening (3), wherein the foil (1) is deformable along the bending line (2) to form a cap-like spatial structure;

a first receiver opening (4) and a second receiver opening (5) disposed close to an outer edge of the foil; an illuminating device (8) to be placed into the opening (3);

a clamping device (7) to be placed into the first receiver opening (4) and the second receiver opening (5), thereby maintaining the cap-like spatial structure of the foil (1);

a connection cable (12) or another suitable means for supplying current.

20. Device component kit for assembling a lamp according to claim 19, wherein the clamping device (7) includes a device for regulating the light intensity and/or the current supply, the transformers, the ignition loading series device, and the like.

21. Method for forming a lamp body, wherein a bendable, elastic foil (1) exhibits approximately in the center an open or closed bending line (2), wherein the bending line (2) surrounds an opening (3) for receiving the illuminating device (8) and/or the current-carrying parts, wherein the bendable, elastic foil (1) is pushed to a curved central wave fold by exerting a light pressure from two sides toward the middle, wherein the wave fold runs out at the bending line (2), wherein the foil (1) assumes a cap-like spatial structure based on a partial deformation along the bending line (2) caused by the pressure, and wherein the bending tension can be maintained by a suitable clamping device (7), and wherein the entire lamp body is stable and fixed in this spatial structure, wherein the bending line (2) is disposed centered in the middle of the foil (1) or is disposed eccentrically on the center axis of the foil (1) shifted downwardly.

22. A lamp comprising a lamp body formed by one single device component, an illuminating device attached to the lamp body, wherein the device component is formed of a foil made of a bendable, elastic material, wherein the foil exhibits a bending line near a center of the foil, wherein the foil contains an opening for receiving the illuminating device and/or current-carrying parts, wherein the bending line surrounds the opening, wherein the foil is formed to a curved, central wave fold by exerting a light pressure from two sides toward the center of the foil based on the bendable and elastic properties of the foil, wherein the curved, central wave fold ends at said bending line, wherein the foil assumes a cap-like spatial structure based on a partial deformation along the bending line caused by the light pressure, a clamping device retaining the shape of the foil, wherein a bending tension of the foil is maintained by the clamping device;

current-carrying parts mounted to the lamp body and connected to the illuminating device, and wherein the entire lamp body is stable and fixed in this spatial structure, wherein the bending line is disposed centered in the middle of the foil or is disposed eccentrically on the center axis of the foil shifted downwardly.

* * * * *